United States Patent [19]

Verwey et al.

[11] Patent Number: 4,574,732

[45] Date of Patent: Mar. 11, 1986

[54] OVERVARNISH UNIT

[75] Inventors: William G. Verwey, Phoenix, Md.; John C. Hovekamp, Burton, Ohio

[73] Assignee: Feco Engineered Systems, Inc., Cleveland, Ohio

[21] Appl. No.: 616,862

[22] Filed: May 29, 1984

Related U.S. Application Data

[63] Continuation of Ser. No. 491,715, May 5, 1983, abandoned.

[51] Int. Cl.[4] ..... B05C 1/08; B05C 11/00

[52] U.S. Cl. ..... 118/642; 118/46; 118/210; 118/224; 118/262; 118/608

[58] Field of Search ..... 118/46, 210, 224, 262, 118/642, 608

[56] References Cited

U.S. PATENT DOCUMENTS 2,329,034 9/1943 Buck et al. ..... 118/210

3,647,525 3/1972 Dahlgren ..... 118/262 X

FOREIGN PATENT DOCUMENTS 31-079 7/1981 European Pat. Off. ..... 118/642

*Primary Examiner*—Evan K. Lawrence

*Attorney, Agent, or Firm*—Patrick J. Walsh

[57] ABSTRACT

Disclosed is an overvarnish unit for applying varnish to a web of printed material as a protective overlay. The overvarnish unit includes a varnish fountain for receiving paste varnish, a form roller, and a plurality of rollers intermediate the fountain and form roller. The form roller engages an impression cylinder roller forming part of a printing assembly. The varnish is transferred from the fountain to the form roller by the intermediate rollers which also mill the varnish as it is being transferred to reduce its viscosity. The form roller is driven at a peripheral speed greater than the linear speed of the web over the impression cylinder roller. This form roller overspeed provides a smearing action in applying the varnish to the web rather than a one to one or line by line printing action thus achieving control over the thickness of the applied varnish and the appearance of the final product.

6 Claims, 1 Drawing Figure

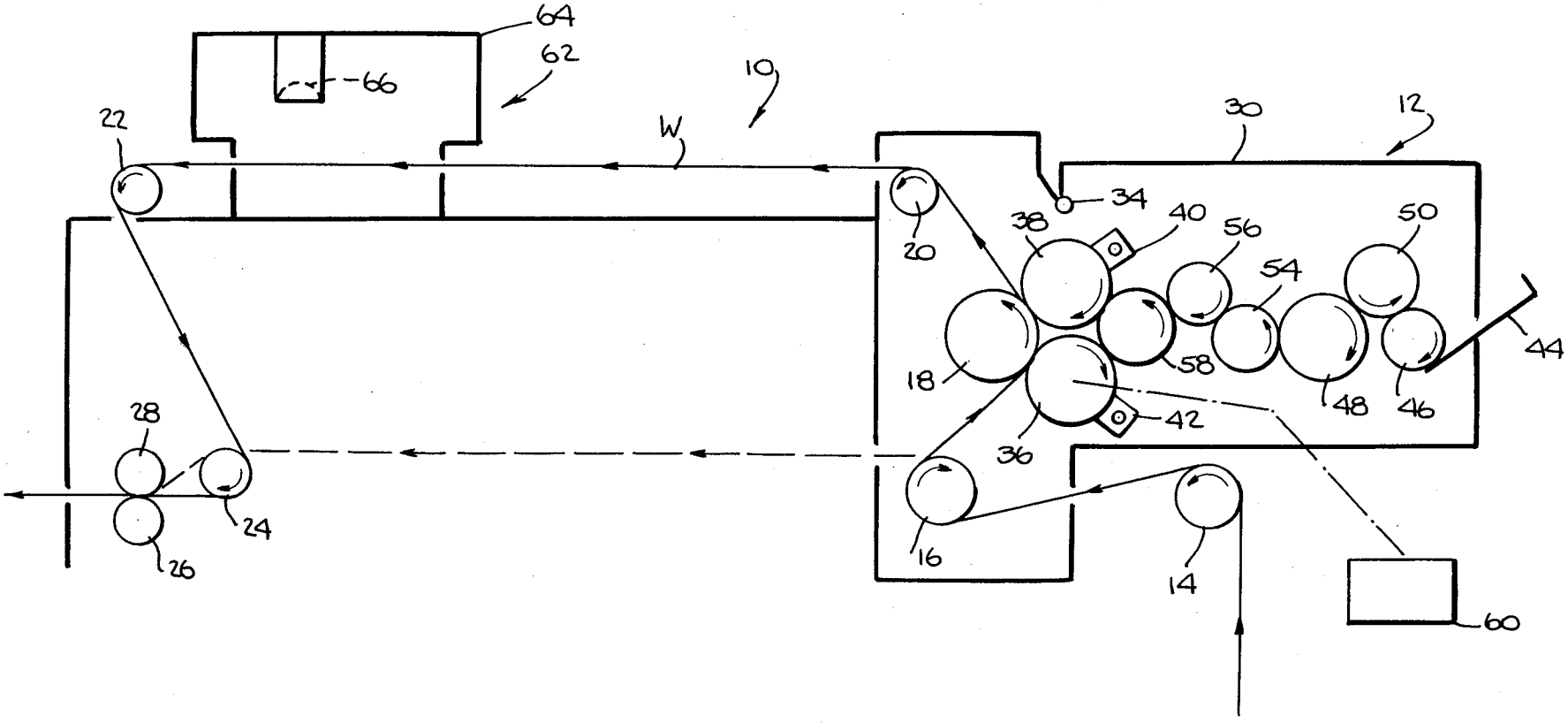
44
60
12
50
46
48
54
30
56
58
40
42
14
34
38
36
20
18
16
10
W
64
62
66
24
22
28
26

OVERVARNISH UNIT

This is a continuation of application Ser. No. 491,715 filed May 5, 1983 abandoned.

BACKGROUND OF THE INVENTION

The present invention relates to an overvarnish unit for applying varnish to a web of printed material and particularly relates to an overvarnish unit for smearing varnish, for example paste varnish, onto a web of printed material in a manner enabling control over the thickness of the varnish deposited on the web and permitting the varnish to be applied to the web in a continuous rather than by a batch type process.

Overvarnishing is the application of a varnish overlay to printed material in the course of a printed process wherein the varnish serves as a protective coating to the printed material. Presently, this is accomplished by means of an ink station forming part of the printing press. That is, the printer will normally dispose a liquid varnish in an ink fountain at an ink station and the varnish will be deposited on the web similarly as if the web was being printed with ink. In conventional printing procedure, the peripheral speed of the printing roller is the same as the linear speed of the web. Thus, contact between the printing roller and the web is made momentarily; i.e., point to point or one line at a time. Stated differently, there is no relative movement between the printing roller and the web as the web passes over the roller. Hence control over the thickness of the varnish applied to the web and its final appearance cannot be maintained.

Further, most varnish coatings applied in conjunction with printing presses utilize a liquid varnish. This liquid varnish is provided in relatively large containers; e.g., five gallon drums. Overvarnishing, however, uses up the varnishing material at a rather rapid rate, particularly in the larger printing roller sizes; e.g., rollers ten, twelve and fourteen inches wide. Consequently, the supply of varnish must be replenished with great frequency; e.g.. every two or three hours. This replenishment, however, requires the machine to be shut down. Accordingly, there has arisen a need for an overvarnish unit which minimizes or eliminates the foregoing and other problems associated with prior overvarnish units and which affords various advantages in construction, operation and end product.

SUMMARY OF THE PRESENT INVENTION

Accordingly, it is a primary object of the present invention to provide a novel and improved overvarnish unit wherein the thickness of the varnish applied to the web can be accurately controlled.

It is another object of the present invention to provide a novel and improved overvarnish unit wherein the varnish is applied by a smearing action rather than by a point to point or line to line contact between the printing roller and the web.

It is still another object of the present invention to provide a novel and improved overvarnish unit wherein the appearance of the final product; e.g., the printed material with the varnish overlay, is substantially improved.

It is a further object of the present invention to provide a novel and improved overvarnish unit wherein a paste type varnish may be utilized.

It is a related object of the present invention to provide a novel and improved overvarnish unit wherein the printing process may be continuous without the need to shut down the printing press to replace the supply of varnish.

To achieve the foregoing and other objects of the present invention and in accordance with the purposes hereof, as embodied and broadly described herein, an overvarnish unit for varnishing a web of printed material in accordance with the present invention may comprise a press assembly having a rotatable impression cylinder for receiving a web driven at a predetermined linear speed, a form roller in contact with the web on the impression cylinder, a varnish fountain, means for transferring varnish from the varnish fountain to the form roller, and means for driving the form roller at a peripheral speed different than the linear speed of the web over the impression cylinder enabling the varnish to be smeared onto the web.

In a preferred embodiment of the present invention, the drive means drives the form roller at a peripheral speed greater than the linear speed of the web over the plate cylinder. Also, the transfer means includes means for milling the paste varnish to reduce its viscosity for application to the web by the form roller.

The accompanying drawing, which is incorporate in and constitutes a part of this specification, illustrates a preferred embodiment of the present invention, and, together with the description, serves to explain the principles of the invention.

BRIEF DESCRIPTION OF THE DRAWING

The sole FIGURE is a schematic illustration of an overvarnish unit constructed in accordance with the present invention and illustrating the overvarnish unit dispensing rollers, printing assembly rollers and the web of printed material as it traverses the various rollers.

DESCRIPTION OF A PREFERRED EMBODIMENT

Referring now to the FIGURE, there is illustrated a press assembly, generally designated 10, forming part of a printing press and an overvarnish unit therefor, generally designated 12. A web of printed material, generally designated W, is also indicated by the solid lines bearing arrows, the arrows indicating the direction of movement of the web through the printing station. The dashed lines with the arrows indicate an arrangement of the web and its direction of movement through the press station 10 when the overvarnish unit 12 is not utilized.

From a review of the drawing FIGURE, it will be appreciated that web W is continuously fed into and through press assembly 10 from a prior printing station forming part of a press line, not shown. The web W immediately preceding press assembly 10 is fed through a festoon box, also not shown, for taking up slack in the web for machine arrangements in which the press has an indexing die cutter. Web W is fed over a pair of spaced take up rollers 14 and 16. From roller 14, web W extends about an impression cylinder roller 18 and then about a pair of longitudinally spaced rollers 20 and 22. Web W then passes over a roller 24 and between a pair of rollers 26 and 28 for travel to further printing operations, not shown, for example cutters, etc. One or more of these rollers is driven by means, not shown, to drive web W along the rollers at a predetermined speed. Also web W is adapted to pass from roller 16 directly to roller 24 in the event overvarnish unit 12 is not utilized; e.g., when varnish is not being applied thereby bypassing rollers 18, 20 and 22. This is indicated by the dashed line with arrows indicating the direction of web travel. It will be appreciated that rollers 14, 16, 18, 20, 22, 24, 26 and 28 are all suitably mounted on and form a part of the press assembly 10.

Turning now specifically to the overvarnish unit 12, unit 12 includes a housing 30 which is detachably mounted on the press assembly 10 by a pair of upwardly opening hooklike members on press assembly 10 which receive a bar 34 carried by unit 12. A pair of adjustable form rollers 36 and 38 are carried by housing 30 with at least one roller 36 engaging the impression roller 18 of the press assembly with the web W therebetween. Form rollers 36 and 38 are mounted on pivoted arms 40 and 42 carried by housing 30 and screws cooperate between housing 30 and arms 40 and 42 for adjusting the location of the rollers and their pressure vis-a-vis impression cylinder roller 18.

Varnish is supplied to the form rollers from a varnish fountain 44 by a series of transfer rollers. Particularly, varnish is fed to a fountain roller 46 in contact with the fountain 44. From fountain roller 46, varnish is transferred to a ductor roller 48, a nip roller 50 being disposed therebetween. A receiver roller 54 receives varnish from ductor roller 48 for transferring varnish to an idler roller 56 and an oscillating roller 58. Oscillating roller 58 engages form rollers 36 and 38 and thus transfers varnish onto web W passing between the form rollers and the impression cylinder roller.

In accordance with the present invention, the overvarnish unit 12 is designed particularly for handling and dispensing paste varnish. The paste varnish is supplied to the varnish fountain 44 by depositing it in paste form into fountain 44, for example by means of a spatula. The rollers between varnish fountain 44 and form rollers 36 and 38, in addition to transferring the varnish from the fountain to the form rollers, serve also as a mill for the varnish. That is, the varnish is worked by the various rollers of the overvarnish unit by rotating them at different speeds as the varnish is transferred to decrease its viscosity to a level sufficiently low for deposition on Web W. While the preferred form of the present invention utilizes paste varnish in the overvarnish unit, it will be appreciated that a liquid varnish may also be utilized with the overvarnish unit herein described. Because of the tendency of the paste varnish to set-up and "freeze" the bearings of the rollers of the overvarnish unit, special but conventional bearings that allow flushing with a solvent are provided for the rollers to maintain low friction values.

It is a particular feature of the present invention that the varnish is smeared onto the web 10 rather than applied by a printing action thus enabling control over the thickness of the applied varnish and also over the final appearance of the web. This smearing action may be analogized to a painting action; e.g., an application moving at a different speed than the surface receiving the application, rather than a point to point or line to line application as in a printing process. Particularly, form roller 36 and 38 are adjusted to run at a faster peripheral speed than the linear speed of web W. To accomplish this, the form rollers are driven by an independent D.C. drive motor 60, which is wired as a slave of the press drive, with a potentiometer controller for adjusting its speed. More particularly, the peripheral speed of the form roller is preferably about 10% greater than the linear speed of the web W and should lie without a range of 1 to 2 times greater for optimum results. Thus, by running the form rollers overspeed, the varnish is smeared onto the web W and by controlling the overspeed relative to the speed of the web W, control over the thickness of the varnish applied to the web W and hence its final appearance is achieved.

A curing station 62 is provided if U.V. curable varnishes are used downstream of the overvarnish unit. Particularly, curing station 62 includes a housing 64 for an ultraviolet lamp 66. Lamp 66 is situated above web W on its varnished side as web W traverses printing assembly 10. Lamp serves to cure the varnish applied to web W.

In use, the linear speed of the web W passing over the rollers of the printing assembly is set. Paste varnish is supplied to the fountain 44 (the fountain meters the supply of varnish into the roller train) and the peripheral speed of the form rollers is set in excess of the linear speed of web W, depending on the desired thickness of the varnish overlay, by adjusting the controller. The varnish is thus transferred from fountain 44 to the form rollers by the various rollers of the overvarnish unit while simultaneously the rollers also mill the paste varnish to reduce its viscosity. Because the form rollers are at a peripheral speed greater than the linear speed of the web, the varnish is smeared onto the web at a controlled thickness. The web then passes through the curing station 62 where the applied varnish is cured by the ultraviolet lamp as the web moves along the printing assembly.

It will be apparent to those skilled in the art that various modifications and variations can be made in the overvarnish unit hereof without departing from the scope or spirit of the present invention.

What is claimed is:

1. An overvarnish unit for varnishing a web comprising:

a press assembly having a rotatable impression cylinder for receiving a web driven at a predetermined linear speed, one or more form rollers in contact with the web on said impression cylinder, a varnish fountain, a fountain roller in contact with the fountain for receiving varnish therefrom, a plurality of willing rollers positioned in serial rolling contact with each other for transferring varnish from the fountain roller to the one or more form rollers and for milling the varnish as it is being transferred so as to reduce the viscosity of the varnish for ease of deposition on the web, and means for driving said one or more form rollers at a peripheral speed different than the linear speed of the web over the impression cylinder enabling the varnish to be smeared onto the web.

2. An overvarnish unit according to claim 1 wherein said driving means drives said form roller at a controllable peripheral speed greater than the linear speed of the web.

3. An overvarnish unit according to claim 1 wherein said varnish fountain is adapted to receive varnish in paste form.

4. An overvarnish unit according to claim 1 wherein said plurality of milling rollers rotate at different speeds in engagement with one another for working the paste varnish to reduce its viscosity.

5. An overvarnish unit according to claim 1 including an ultraviolet lamp carried by said press assembly disposed at a location downstream of said form roller for curing the varnish smeared onto the web.

6. An overvarnish unit according to claim 5 wherein said driving means drive said form roller at a peripheral speed greater than the linear speed of the web, and said varnish fountain being adapted to receive varnish in paste form.

* * * * *